US006122839A

United States Patent [19]

D'Hollander

[11] Patent Number: 6,122,839

[45] Date of Patent: Sep. 26, 2000

[54] CONTACTING OF ARTICLES WITH A GAS

[76] Inventor: Gilbert Franciscus Evarist D'Hollander, 217 Sekelbos Street, Hectorspruit 1330, South Africa

[21] Appl. No.: 09/229,281

[22] Filed: Jan. 13, 1999

[30] Foreign Application Priority Data

Jan. 15, 1998 [ZA] South Africa ..... 98/0338

[51] Int. Cl.[7] ..... F26B 3/00

[52] U.S. Cl. ..... 34/492; 34/507

[58] Field of Search ..... 34/402, 437, 443, 34/487, 492, 507, 90, 103, 104, 106, 202, 211, 218, 222, 225

[56] References Cited

U.S. PATENT DOCUMENTS 3,100,106 8/1963 Bielenberg et al. ..... 34/507 X
3,287,824 11/1966 Selditz ..... 34/202
4,358,899 11/1982 Murch et al. ..... 34/507
5,084,984 2/1992 Duchoud et al. ..... 34/202 X
5,249,367 10/1993 Nafziger et al. ..... 34/202 X
5,778,557 7/1998 Leavens ..... 34/222
5,862,609 1/1999 Stevens et al. ..... 34/507 X
5,893,218 4/1999 Hunter et al. ..... 34/492

*Primary Examiner*—Stephen Gravini
*Attorney, Agent, or Firm*—Gifford, Krass, Groh, Sprinkle, Anderson & Citkowski, P.C.

[57] ABSTRACT

A method of contacting an article placed in a chamber with a gas flowing through the chamber includes the step of displacing at least one interior surface in or of the chamber relative to the article so that the surface and the article are positioned adjacent one another to inhibit the flow of gas between them and to encourage the flow of gas into contact with the article.

15 Claims, 2 Drawing Sheets

10
12
14
16
18
20
22
24
26
30
32
33
38
40
44
46
48
50
51
52
54
56
58
59
II 10
12
14
16
22
24
26
28
30
32
34
36
38
40
42
44
48
50
51
52
54
58
59

CONTACTING OF ARTICLES WITH A GAS

This invention relates to the contacting of articles with a gas. In particular, it relates to a method and to a room for contacting articles placed in the room with a gas.

According to a first aspect of the invention, there is provided a method of contacting an article placed in a chamber with a gas flowing through the chamber, which method includes the step of displacing at least one interior surface in or of the chamber relative to the article so that the surface and the article are positioned adjacent one another to inhibit the flow of gas between them and to encourage the flow of gas into contact with the article.

Displacing at least one interior surface in or of the chamber may include displacing an elevated generally horizontally extending interior surface provided above the article so that it is positioned against the top of the article.

Displacing an elevated interior surface in or of the chamber may include displacing the elevated interior surface between a raised position to facilitate loading and unloading of the article into and out of the chamber and a lowered position against the top of the article.

The method may include sensing when an article or articles is to be loaded into or unloaded out of the chamber, and automatically raising and lowering the elevated interior surface before and after the article or articles is loaded and before and after the article or articles is unloaded.

The article may be one of a plurality of similar articles stacked in one or more rows, e.g. on pallets. The method may include coercing the gas flowing through the chamber to enter each row of articles from a side of the row by restricting or inhibiting access to an end of each row of articles.

Restricting or inhibiting access to an end of each row of articles may include providing a generally vertically extending gas flow barrier, e.g. a curtain, in front of the end of each row of articles. Instead, or in addition, restricting or inhibiting access to an end of each row of articles may include positioning the articles at the end such that the flow of gas in between the articles from the end is restricted or inhibited.

According to a second aspect of the invention, in a method of contacting an article placed in a chamber having an overhead gas flow passage defined between an elevated upper surface and an elevated lower surface spaced from the elevated upper surface, with a gas, there is provided the improvement whereby a flow of gas through the chamber is influenced by displacing the elevated lower surface and the article relative to each other so that the elevated lower surface is at substantially the same elevation as the top of the article to inhibit the flow of gas between the elevated lower surface and the top of the article.

Displacing the elevated lower surface and the article relative to each other may include adjusting the elevation of a generally horizontally extending gas flow barrier which defines the elevated lower surface. The elevation of the generally horizontally extending gas flow barrier may be adjusted so that the generally horizontally extending gas flow barrier is in contact with the top of the article when the article is being contacted with the gas.

The generally horizontally extending gas flow barrier may be displaced into a raised position when loading and unloading the article or articles into and out of the chamber. Thus, the method may include sensing when an article or articles is to be loaded into or unloaded out of the chamber and automatically raising and lowering the generally horizontally gas flow barrier before and after the article or articles is loaded and before and after the article or articles is unloaded.

The article may be one of a plurality of similar articles stacked in one or more rows, e.g. on pallets. The method may then include feeding the gas from an outlet of the overhead passage into a side of each row, and returning the gas to an inlet of the overhead passage in the vicinity of a rear end of each row. The method may include coercing the gas flowing through the chamber to enter each row of articles from a side of the row by restricting or inhibiting access to an end of each row of articles.

Restricting or inhibiting access to an end of each row of articles may include providing a generally vertically extending gas flow barrier, e.g. a curtain, in front of the end of each row of articles, which is typically a front end of each row of articles. Instead, or in addition, restricting or inhibiting access to an end of each row of articles may include positioning the articles at the end such that the flow of gas in between the articles from the end is restricted or inhibited.

According to a third aspect of the invention, there is provided a room for contacting articles with a gas, the room defining a chamber within which articles are receivable and through which a gas can flow or circulate, at least one interior surface in or of the chamber being displaceable between a first or retracted position in which it facilitates the loading and unloading of articles into and out of the chamber and a second or extended position in which it is positioned adjacent to articles positioned in the chamber to inhibit the flow of gas between the interior surface and the articles.

The displaceable interior surface may be defined by a vertically displaceable generally horizontally extending elevated gas flow barrier, and the room may include an overhead gas flow passage.

According to a fourth aspect of the invention, there is provided a room for contacting articles placed in the room with a gas, the room including an overhead gas flow passage defined between an elevated upper surface and an elevated lower surface, the elevated lower surface being spaced from the elevated upper surface and being defined by a generally horizontally extending elevated gas flow-barrier, the elevated gas flow barrier being vertically displaceable thereby to influence the flow of gas through the room.

The room may include displacement means acting on the elevated gas flow barrier for raising or lowering the elevated gas flow barrier.

In one embodiment of the invention, the displacement means includes a lever arrangement for raising or lowering the elevated gas flow barrier, the lever arrangement being manually operable or operable by means of an electric motor.

In another embodiment, the displacement means includes hydraulic or pneumatic cylinders connected to the elevated gas flow barrier for raising or lowering the elevated gas flow barrier.

In yet another embodiment, which the Applicant expects to be a preferred embodiment, the displacement means includes a plurality of elongate flexible elements, such as cables, chains, ropes, or the like attached to the elevated gas flow barrier at spaced apart positions, at least one reel and winding means, e.g. an electric motor, for winding and unwinding the elongate flexible elements on the reel, thereby to raise and lower the elevated gas flow barrier.

The room may include sensing means for sensing when an a article is being loaded into or unloaded out of the chamber or room, the sensing means automatically activating the displacement means to raise the elevated gas flow barrier when an article is being loaded or unloaded, and to lower the elevated gas flow barrier once the article has been loaded or unloaded.

The room may include a displaceable door through which articles are loaded into or removed from the chamber. The sensing means may sense the position of the door and may activate the displacement means to raise the elevated gas flow barrier when the door is opened far enough to pass an article through the door opening, and to lower the elevated gas flow barrier when the door is closed.

The room may include at least one switch means for deactivating the displacement means, e.g. limit switches and/or time switches for stopping an electric motor, when the elevated gas flow barrier has reached a set maximum or a set minimum elevation.

The room may be elongate an may be rectangular and may include at least one transversely generally vertically extending gas flow barrier, e.g. a curtain, a longitudinal position of the vertical gas flow barrier in the room being adjustable. The vertical gas flow barrier may thus include positioning means, e.g. a longitudinally extending railing or railings, whereby the longitudinal position of the vertical gas flow barrier in the room can be adjusted.

The elevated gas flow barrier may include a frame and a sheet of flexible material spanning the frame. Instead, the elevated gas flow barrier may comprise a plurality of rigid panels connected to each other, e.g. chromadek panels, corrugated zinc panels, steel panels, wooden panels, compressed cardboard panels, or the like.

The elevated gas flow barrier may be spaced from at least one wall of the room, thus providing an outlet for the overhead gas flow passage between an edge of the elevated gas flow barrier and the wall. In one embodiment of the invention, the elevated gas flow barrier is spaced from three of the walls providing an outlet for the gas flow passage extending along three peripheral sides of the elevated gas flow barrier.

The overhead gas flow passage may have an inlet at an end of the room, typically a rear end of the room, at least a portion of a gas flow path between the inlet and the outlet being defined by the overhead gas flow passage. Gas conditioning means, e.g. a chiller unit, a heater, or the like, and gas circulation means, such as a fan, may be located in the gas flow path, e.g. in the overhead gas flow passage.

It is expected that the invention will find application in rooms in which the atmosphere is to be controlled, e.g. by controlling the temperature and/or the humidity and/or the composition of the atmosphere. Thus, it is expected that the invention will find application in rooms for cooling, heating, drying, growing, cultivating or ripening articles such as fruit or vegetables, and in which the gas is thus typically air. The gas may also be a mixture of air and a functional gas, such as a ripening gas.

The invention will now be described, by way of example, with reference to the accompanying diagrammatic drawings, in which FIG. 1 is a longitudinal vertical sectional view of a room in accordance with the invention for contacting articles placed in the room with a gas;

Figure 1:
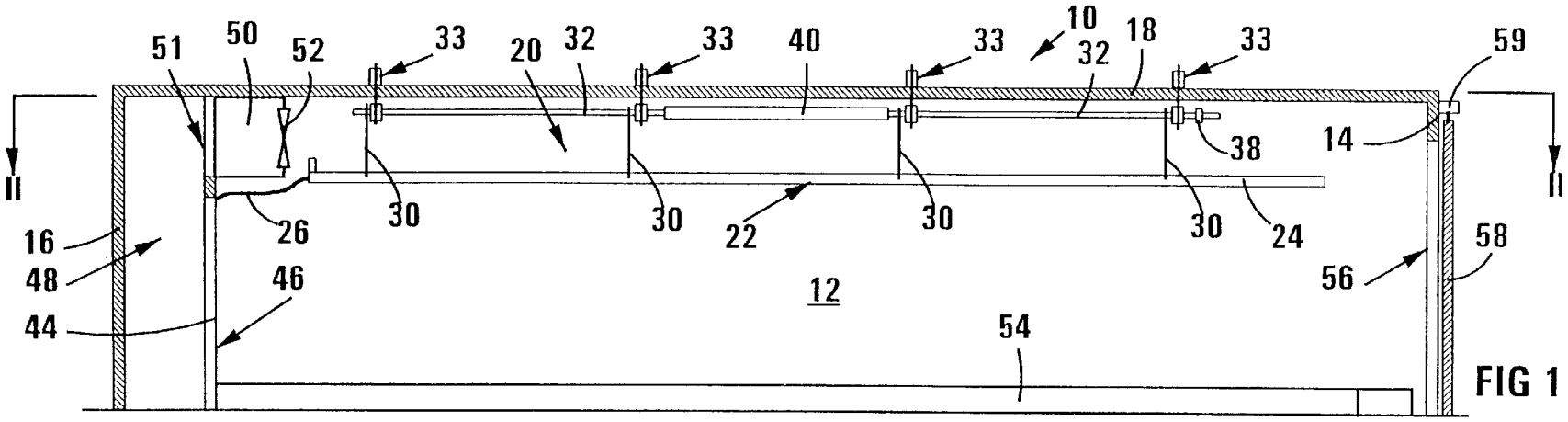

Referring to the drawings, reference numeral 10 generally indicates a room in accordance with the invention for exposing articles placed in the room to chilled air. The room 10 is rectangular in plan view and includes side walls 12, a first transverse end wall 14 and a second transverse end wall 16, a roof 18 and an overhead gas flow passage 20 defined between the roof 18 and a vertically displaceable generally horizontally extending elevated gas flow barrier or ceiling 22. The overhead gas flow passage 20 is thus defined between an elevated upper surface, provided by a lower surface of the roof 18, and an elevated lower surface, provided by an upper surface of the elevated gas flow barrier 22.

The gas flow barrier 22 includes a rectangular frame 24 and a flexible sheet 26 of a synthetic plastics material spanning the frame 24. The sheet 26 is attached to the frame 24 by means of a plurality of fastening and tensioning strings 28 which extend through eyelets in the sheet 26.

Figure 2:
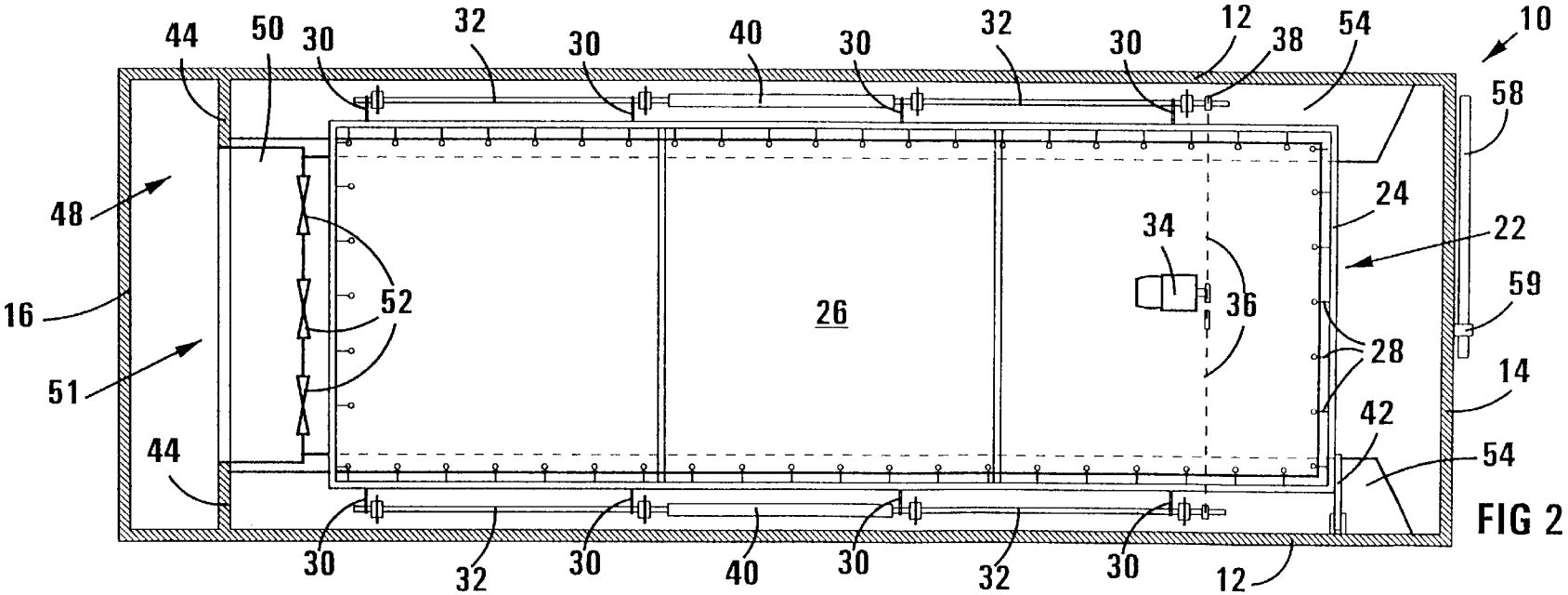
FIG. 2 is a sectioned plan view of the room of FIG. 1 taken at II—II in FIG. 1.

The room 10 includes displacement means which comprises eight ropes 30 attached to the frame 24, four ropes 30 on each long side of the frame 24 at longitudinally spaced apart positions, four elongate parallel reels 32, each reel 32 being longitudinally arranged to wind and unwind two of the ropes 30, and an electric motor 34 (only shown in FIG. 2) drivingly connected by means of a drive chain 36 and sprockets 38 to two of the reels 32. The two reels 32 which are driven by the electric motor 34, are each in turn drivingly connected by means of an elongate coupling 40 to an associated reel 32. The reels 32 are rotatably suspended from the roof 18 by means of suspension arrangements 33. The electric motor 34 is a brake motor, locking the reels 32 when the motor 34 is not winding or unwinding the reels 32, and is suspended from the roof 18.

A limit switch 42 (see FIG. 2) is provided against one of the side walls 12 for sensing the elevation of the elevated gas flow barrier 22, to stop the electric motor 34 when the elevated gas flow barrier 22 has reached a set maximum or a set minimum elevation. Other electric control equipment (not shown) are also provided, and include a time switch which automatically stops the motor 34 if it is running longer than it should. For example, if the normal travel time for the elevated gas flow barrier 22 is five seconds between its minimum and maximum required elevations, the motor 34 is stopped automatically after 6 seconds by the time switch.

The room 10 includes a transverse dividing wall 44 spaced from the second end wall 16. An opening 46 in the dividing wall 44 leads into an inlet 48 to the overhead gas flow passage 20, the inlet 48 being defined by a chamber formed between the second end wall 16 and the dividing wall 44. The sheet 26 extends between the frame 24 and the dividing wall 44. The portion of the sheet 26 extending between the frame 24 and the dividing wall 44 is of sufficient length so that the frame 24 is free to be raised or lowered, at least between its required maximum and minimum elevation.

Conditioning means, in the form of a chiller unit 50 having three fans 52 is located in the gas flow path 20, proximate the inlet 48. The chiller unit 50 is mounted to the roof 18 of the room 10, and draws air from the inlet 48 through a rectangular opening 51 in the dividing wall 44.

The room 10 includes two longitudinally extending curbs 54, each curb 54 abutting one of the side walls 12 respectively and the dividing wall 44. Each curb 54 has a tapered end proximate the first end wall 14.

The room 10 also includes a door opening 56 and a sliding door 58 for the door opening 56. Sensing means 59 (See FIGS. 1 and 2) is provided to sense the position of the sliding door 58.

Figure 3:
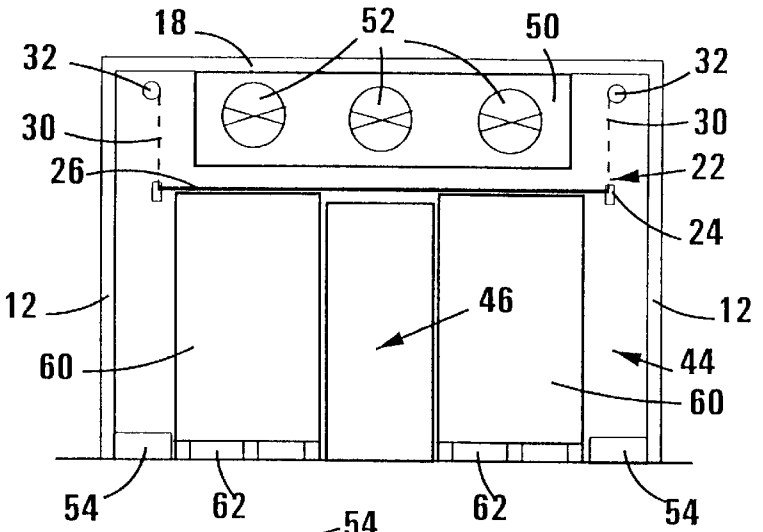
FIG. 3 is a schematic end view of the interior of the room of FIG. 1, and shows pallets with articles stacked thereon in the room.

The room 10 is used for cooling perishable articles in stacks 60 of stackable containers stacked on pallets 62 (see FIG. 3). The stacks 60 and pallets 62 are arranged in two parallel rows extending longitudinally inside the room 10. As can be seen in FIG. 3, each row of pallets 62 and stacks 60 is located next to one of the curbs 54, with a space being left open between the two rows. Typically, all the stacks 60 on the pallets 62 are of equal height.

The elevated gas flow barrier 22 is lowered by means of the electric motor 34, the ropes 30 and reels 32 so that the flexible sheet 26 is in contact with or closely spaced from the top of each stack 60.

Air is drawn from the inlet 48 through the opening 51 into the chiller unit 50 by means of the three fans 52. The chiller unit 50 cools the air and the cold air is blown by means of the fans 52 in between the elevated gas flow barrier 22 and the roof 18 of the room 10. The cold air flows through the gaps between the elevated gas flow barrier 22 and the side walls 12 and the first end wall 14 and is circulated back to the inlet 48 through the opening 46 in the dividing wall 44. The cold air is forced to enter the rows of stacks 60 and pallets 62 generally horizontally from their sides facing the side walls 12, by suspending a transversely generally vertically extending gas flow barrier, in the form of a curtain of a synthetic plastics material (not shown), from longitudinally extending railings (not shown) on the elevated gas flow barrier 22 in front of the rows of pallets 62 and stacks 60, between the rows and the first end wall 14. The curbs 54 prevent the cold air from entering the rows underneath the pallets 62, and thus force the cold air in between the stacked containers of the stacks 60, the containers typically being adapted to provide flow paths between them when stacked. The containers may also have openings to allow the cold gas to flow through them.

Figure 4:
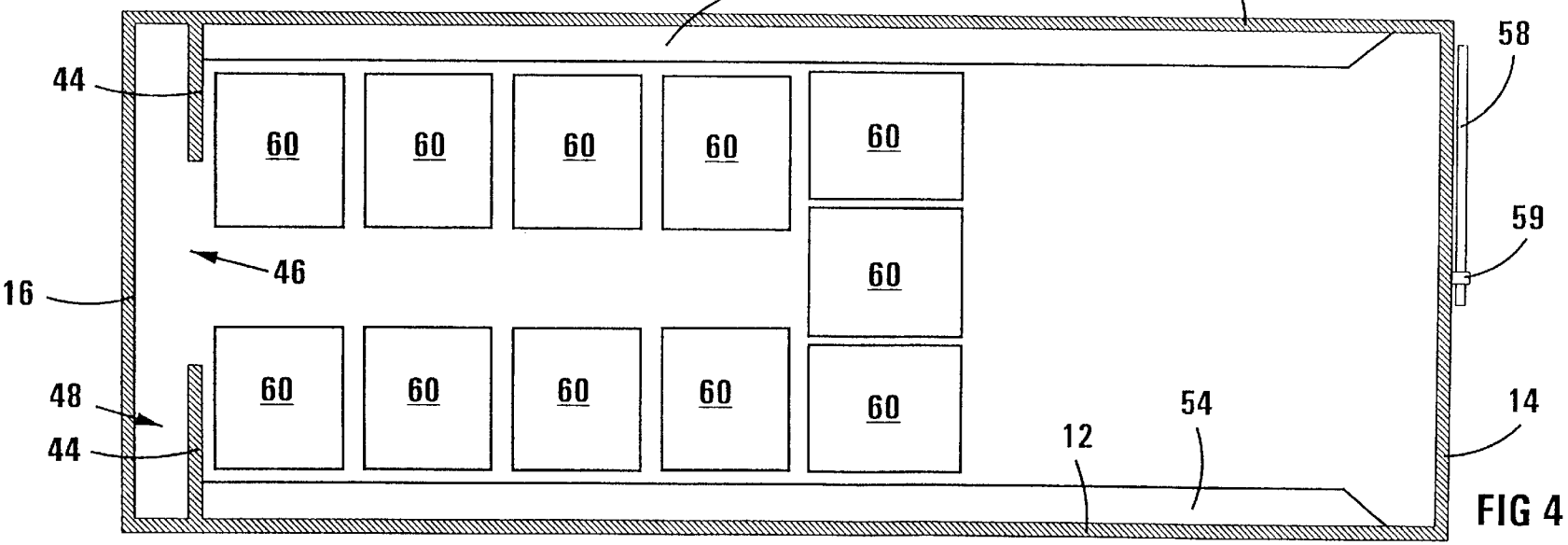
FIG. 4 is a sectioned plan view of the room of FIG. 1, for clarity without some components, and shows another arrangement of pallets in the room.

Referring to FIG. 4, another approach to force the cold air to enter the rows from their sides, is shown. As can be seen in FIG. 4, instead of blocking access to the front of the rows by means of a curtain, three pallets 62 and their stacks 60 are used to form a barrier extending across the front of the rows. This approach however has the disadvantage that more work is required to add a pallet 62 with its stack 60 to one of the rows.

If a pallet 62 with a stack 60 is to be added to one of the rows, the door 58 is opened wide enough to allow a fork lift truck or pumpcart (not shown) transporting the pallet 62 and stack 60 to enter the room 10. The sensing means 59 senses that the door 58 has been opened far enough to allow the fork lift truck to enter, and automatically starts the motor 34 to raise the elevated gas flow barrier 22. When the elevated gas flow barrier 22 has reached a set maximum elevation, as detected by the limit switch 42, the motor 34 is stopped, retaining the elevated gas flow barrier 22 at its maximum elevation. The fork lift truck deposits the pallet 62 with its stack 60 at the front of one of the rows, and leaves the room 10 via the door opening 56. The curtain can then be adjusted in front of the rows, to force the cold air to enter the rows from their sides. The door 58 is then closed. The sensing means 59 senses that the door has been closed, and starts the electric motor 34 to lower the elevated gas flow barrier 22. Once the elevated gas flow barrier 22 has reached the elevation of the top of the stacks 60, as set on and detected by the limit switch 42, the electric motor 34 is stopped again.

In another embodiment of the invention (not shown), the motor 34 and most of the electronic control equipment is mounted on top of the roof 18, with the ropes 30 extending through passages in the roof 18. This embodiment is particularly suitable where corrosive gases are present in the room 10. In this embodiment, a single reel 32 is located on the roof centrally relative to the elevated gas flow barrier 22 and extends longitudinally relative to the elevated gas flow barrier 22. The reel 32 is in line with the motor 34. However, it is to be appreciated that more than one reel 32 can be employed as described above, if desired.

In yet another embodiment of the invention (not shown) the motor 34 and the reels 32 are mounted on top of the elevated gas flow barrier 22, with ends of the ropes 30 being anchored against the roof 18.

It is an advantage of the room 10, as illustrated, that it is easier to add or remove pallets to or from the room 10 than conventional cold storage rooms. The Applicant also believes that it is an advantage of the room 10, as illustrated, that it is more effective in establishing contact between articles placed in the room and a circulating gas, than conventional rooms built for this purpose.

What is claimed is:

1. A method of contacting a plurality of similar articles stacked vertically into stacks which stacks are arranged in at least one row in a chamber with a gas flowing through the chamber, which method includes the step of displacing at least one interior surface in the chamber relative to the stacked articles so that the surface and the top of each stack of articles are positioned adjacent one another to inhibit the flow of gas into contact with the stacked articles from above, thereby to promote the flow of gas into contact with the stacked articles from other directions.

2. A method as claimed in claim 1, in which displacing at least one interior surface in the chamber includes displacing an elevated generally horizontally extending interior surface provided above the stacked articles so that it is positioned against the top of each stack of the articles.

3. A method as claimed in claim 2, in which displacing an elevated interior surface in the chamber includes displacing the elevated interior surface between a raised position to facilitate loading and unloading of articles into and out of the chamber and an lowered position against the top of each stack of the articles.

4. A method as claimed in claim 3, which includes sensing when an article is to be loaded into or unloaded out of the chamber, and automatically raising and lowering the elevated interior surface before and after the article is loaded and before and after the article is unloaded.

5. A method as claimed in claim 1, which includes coercing the gas flowing through the chamber to enter each row of stacks of the articles includes providing a generally vertically extending gas flow barrier in front of the end of each row of stacks of the articles from the end is restricted or inhibited.

6. A method as claimed in claim 5, in which restricting or inhibiting access to an end of each row of stacks of the articles includes providing a generally vertically extending gas flow barrier in front of the end of each row of stacks of the articles.

7. A method as claimed in claim 5, in which restricting or inhibiting access to an end of each row of stacks of the articles includes positioning the stacks of the articles at the end such that the flow of gas in between the stacks of the articles from the end is restricted or inhibited.

8. In a method of contacting an article placed in a chamber having an overhead gas flow passage defined between an elevated upper surface and an elevated lower surface spaced from the elevated upper surface, with a gas, there is provided the improvement whereby a flow of gas through the chamber is influenced by displacing the elevated lower surface and the article relative to each other so that the elevated lower surface is at substantially the same elevation as the top of the article to inhibit the flow of gas between the elevated lower surface and the top of the article.

9. A method as claimed in claim 8, in which displacing the elevated lower surface and the article relative to each other includes adjusting the elevation of a generally horizontally extending gas flow barrier which defines the elevated lower surface.

10. A method as claimed in claim 9, in which the elevation of the generally horizontally extending gas flow barrier is adjusted so that the generally horizontally extending gas flow barrier is in contact with the top of the article when the article is being contacted with the gas.

11. A method as claimed in claim 9, in which the generally horizontally extending gas flow barrier is displaced into a raised position when loading and unloading the article into and out of the chamber.

12. A method as claimed in claim 11, which includes sensing when an article is to be loaded into or unloaded out of the chamber and automatically raising and lowering the generally horizontally gas flow barrier before and after the article is loaded and before and after the article is unloaded.

13. A method as claimed in claim 8, in which the article is one of a plurality of similar articles stacked in one or more rows, the method including coercing the gas flowing through the chamber to enter each row of articles from a side of the row by restricting or inhibiting access to an end of each row of articles.

14. A method as claimed in claim 13, in which restricting or inhibiting access to an end of each row of articles includes providing a generally vertically extending gas flow barrier in front of the end of each row of articles.

15. A method as claimed in claim 13, in which restricting or inhibiting access to an end of each row of articles includes positioning the articles at the end such that the flow of gas in between the articles from the end is restricted or inhibited.

* * * * *